US005590781A

United States Patent [19]

Shackelford et al.

[11] Patent Number: 5,590,781

[45] Date of Patent: Jan. 7, 1997

[54] UNITARY CONFORMABLE SHIPPING CONTAINER

[76] Inventors: Elisabeth Shackelford, 5 Shaler La., Cambridge, Mass. 02138; Nancy Jackson, 58 E. End Rd., Bolton, Mass. 01740

[21] Appl. No.: 376,964

[22] Filed: Jan. 23, 1995

Related U.S. Application Data

[63] Continuation-in-part of Ser. No. 270,608, Jul. 5, 1994, and a continuation-in-part of Ser. No. 186,013, Jan. 24, 1994, abandoned.

[51] Int. Cl.[6] ..... B65D 81/02; B65D 81/03

[52] U.S. Cl. ..... 206/521; 206/591; 229/87.01; 229/87.02; 229/87.03

[58] Field of Search ..... 206/521, 491, 206/591; 229/92, 92.1, 92.8, 921, 300, 301, 302, 68 R, 68.1, 87.01, 87.02, 87.03, 92.7

[56] References Cited

U.S. PATENT DOCUMENTS

| | | | |
|---|---|---|---|
| 882,843 | 3/1908 | Richardson | 229/68 R |
| 1,124,440 | 1/1915 | Hopper | 229/68 R |
| 1,220,796 | 3/1917 | Sutter | 229/87.5 |
| 2,366,575 | 1/1945 | Teicher | 229/92.1 |
| 2,405,327 | 8/1946 | Rend | 229/92.1 |
| 2,600,196 | 6/1952 | Whitman | 229/92.1 |
| 3,068,490 | 12/1962 | Pokras | 4/901 |
| 3,164,317 | 1/1965 | Bogen | 229/92.8 X |
| 3,185,197 | 5/1965 | Spiro et al. | 150/52 |
| 3,187,985 | 6/1965 | Simjian | 229/92.8 |
| 3,217,972 | 11/1965 | McNelis | 229/92.1 |
| 3,276,671 | 10/1966 | Fleitman | 206/521 |
| 3,349,990 | 10/1967 | Woodford | 206/521 |
| 3,380,504 | 4/1968 | Green | 150/154 |
| 3,727,827 | 4/1973 | Stice | 229/37 |
| 3,766,954 | 10/1973 | Gentellalli | 206/315.11 X |
| 3,863,836 | 2/1975 | Austin | 229/92.1 X |
| 4,027,794 | 6/1977 | Olson | 206/395 |
| 4,063,559 | 12/1977 | Tritsch | 128/287 |
| 4,240,240 | 12/1980 | Cohen | 53/410 |
| 4,244,511 | 1/1981 | Coleman | 229/92.1 |
| 4,306,658 | 12/1981 | Montealegre | 206/611 |
| 4,421,150 | 12/1983 | Masters . | |
| 4,506,823 | 3/1985 | Büchler | 229/92.8 |
| 4,674,129 | 6/1987 | Janhonen | 229/92 X |
| 4,750,609 | 6/1988 | Felis | 229/921 X |
| 4,773,534 | 9/1988 | DeHeras et al. | 206/328 |
| 4,795,456 | 1/1989 | Borgers et al. | 604/390 |
| 4,867,372 | 9/1989 | Patterson | 206/521 X |
| 4,881,684 | 11/1989 | Chinman | 229/87 |
| 4,892,193 | 1/1990 | Thomas | 206/453 |
| 4,908,247 | 3/1990 | Bairel et al. | 383/112 X |
| 4,984,906 | 1/1991 | Little | 383/4 |
| 5,004,144 | 4/1991 | Selga | 206/521 |
| 5,040,696 | 8/1991 | Liebel | 220/441 |
| 5,188,877 | 2/1993 | Magro | 220/903 X |
| 5,226,557 | 7/1993 | Nelson | 220/461 |

FOREIGN PATENT DOCUMENTS

| | | | |
|---|---|---|---|
| 938256 | 12/1973 | Canada | 206/591 |
| 2063884 | 9/1992 | Canada | 229/303 |
| 9115406 | 10/1991 | European Pat. Off. | 33/18 |

*Primary Examiner*—Paul T. Sewell
*Assistant Examiner*—Tara Laster
*Attorney, Agent, or Firm*—Weingarten, Schurgin, Gagnebin & Hayes

[57] ABSTRACT

A unitary container for securely packaging objects and protecting such objects from damage during transit. The unitary container is padded to provide protection to the object and is elasticized to be conformable to the shape of the object being packaged. The unitary container includes fasteners which may be releasable to permit reuse of the container and avoid waste.

4 Claims, 10 Drawing Sheets

UNITARY CONFORMABLE SHIPPING CONTAINER

RELATED APPLICATIONS

This application is a continuation-in-part of patent application Ser. No. 08/270,608, entitled UNITARY CONFORMABLE SHIPPING CONTAINER, filed by the applicants of this application on Jul. 5, 1994 (DODSN-001AX) and of application Ser. No. 08/186,013, entitled UNITARY CONFORMABLE SHIPPING CONTAINER, filed by the applicants of this application on Jan. 24, 1994 (DODSN-001XX) and now abandoned.

FIELD OF THE INVENTION

This invention relates to the field of packaging containers for shipping articles in a protective package and more particularly to a conformable elasticized container.

BACKGROUND OF THE INVENTION

Millions of relatively fragile and expensive objects are shipped within the United States and overseas every week. Each one of those objects must preferably be securely packaged in a shipping container and protected by shock-absorbing material if the object is to arrive at its destination without damage. The traditional method of packaging objects for shipping generally includes a time-consuming and labor-intensive five-step process: (1) the item is covered with a layer of protective material such as "bubble-wrap"; (2) the protective material is taped, or otherwise secured in place, around the item being shipped; (3) the item wrapped in the protective material is placed into a box or other rigid container; (4) the excess space in the container around the wrapped item is filled with a further protective material, such as expanded paper, polystyrene beads or "peanuts", and (5) the rigid container is sealed by sticky tape, string, staples or the like. The traditional method of packaging, particularly when used by mail order companies which ship items in extremely high volume, requires a great deal of labor and time. As a result, the packaging and shipping costs can add considerably to the price of the item being sold. A further disadvantage of the traditional method of packaging is that the unpacking process is also time consuming.

Padded envelopes have also been used for shipping items. However, for non-planar items, such envelopes exhibit many of the disadvantages associated with the traditional method of packaging. For example, the envelopes are not conformable to the shape of the item, and additional packaging material is required to stuff the envelope to provide extra protection to the item.

SUMMARY OF THE INVENTION

A unitary conformable packaging container providing for the secure and protected shipment of valuable or fragile items is disclosed. The container includes an outer shell of tough flexible material, one or more layers of padding material to protect the item being shipped, and an inner shell. Alternatively, the padding material can be used without separate inner and outer shells. A plurality of elasticized areas allow the container to be stretched to conform to the shape of the item being shipped to eliminate movement of the item within the container during shipment. The outer surface preferably includes an address label area on which the name and address of the addressee and return name and address can be entered. An adhesive stamp area can be provided on the outer surface of the container to permit a stamp to be affixed without the need to lick or wet the stamp. Integral fasteners releasably secure the container around the item. The invention thereby dispenses with the need for filling excess space within the container with additional packing material. This is especially beneficial for irregularly shaped items. A transparent envelope is affixed to the outer shell to accommodate a shipping label or other shipping documentation such as is used by courier and other shipping services. The container may be manufactured in a reversible configuration. In the reversible configuration, the padding material without separate inner and outer shells is preferably used and the fasteners have strip seals on both surfaces. The container provides significant reduction in the time and labor required to package items as compared with the traditional packaging method previously described. The container also reduces the time and labor required by the recipient to unpack the item. The container according to the present invention may be constructed in a variety of sizes to accommodate different sized items. The container can also be constructed with differing degrees of resilient padding to accommodate varying degrees of fragility of the items being shipped.

BRIEF DESCRIPTION OF THE DRAWINGS

These and further features of the invention may be understood with reference to the accompanying specification and drawing in which.

DETAILED DESCRIPTION OF THE INVENTION

Figure 1:
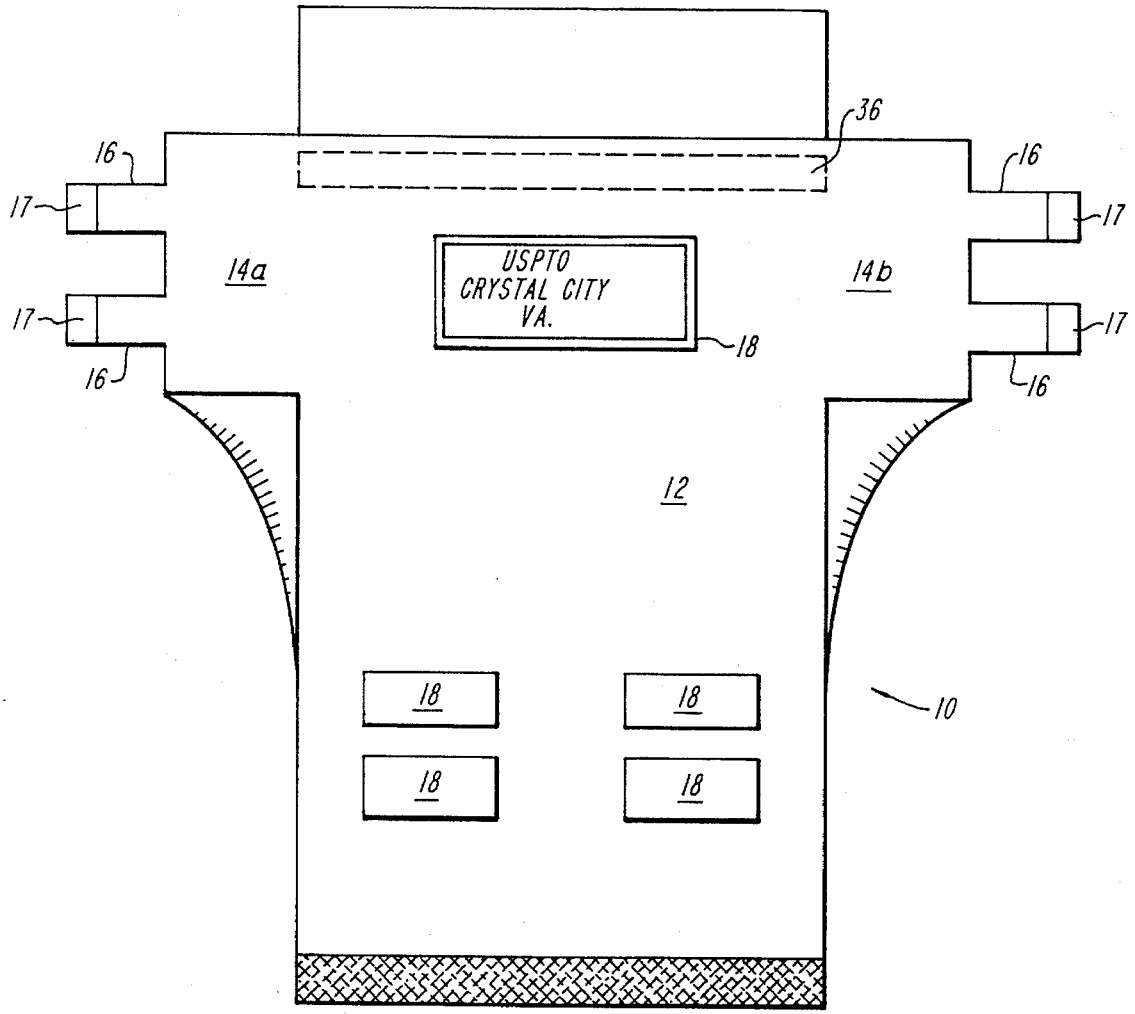
FIG. 1 illustrates a plan view of the outer surface of an embodiment of the present invention.

Referring now to FIG. 1, a front exterior view of an embodiment of the present invention is illustrated. The conformable container 10 includes an outer shell 12 which may be manufactured from a suitable paper or plastic material. The container is preferably made from a reusable material, such as "Tyvac". The container can also be made from biodegradable or recyclable materials which will be known to those of skill in the art. The container includes side tabs 14*a*, 14*b*. Integral with side tabs 14*a*, 14*b* are one or more fasteners 16. The fasteners 16 can include adhesive strip seals or pads of "hook and loop" type material such as Velcro® 17. Adhesive strip seals include a strip of paper over the adhesive which can be removed to expose the adhesive. If adhesive strips are used, multiple adhesive strips may be stacked one on top of the other. The hidden or "virgin" strips disposed beneath the top adhesive strip allow for reuse of the conformable container. The adhesive strips can also be arranged in a side-by-side configuration to permit consecutive use of the fasteners when the container is used more than once. The first recipient of the container removes and discards the top, used adhesive strip. The subsequent adhesive strips in the stack are then available to reseal the package for reuse. The use of hook and loop material also permits reuse of the conformable container. This is advantageous in environments where security of the container is not a major factor, such as inter-office mail applications. When hook and loop type material is used with the fasteners, respective corresponding pads of hook material securely engage the loop material of the fasteners 16 when the container is closed.

A transparent envelope 19 affixed to the container houses an addressing label 20. The envelope 19 may be repeatedly opened and closed so that the addressing label may be replaced as desired. Additional labels may be contained in the pocket 18 to facilitate reuse of the container by the recipient. The envelope 19 may also be used by courier and other shipping services to display shipping documentation. If a transparent envelope is not desired, the area can be identified as the location at which the addressee's and sender's names and addresses can be written. An envelope which can also be transparent can also be affixed to the inner shell of the container for containing and/or displaying billing or other information. In a reversible embodiment of the invention, the inner transparent envelope can be used to display shipping information when the container is reversed.

Figure 2:
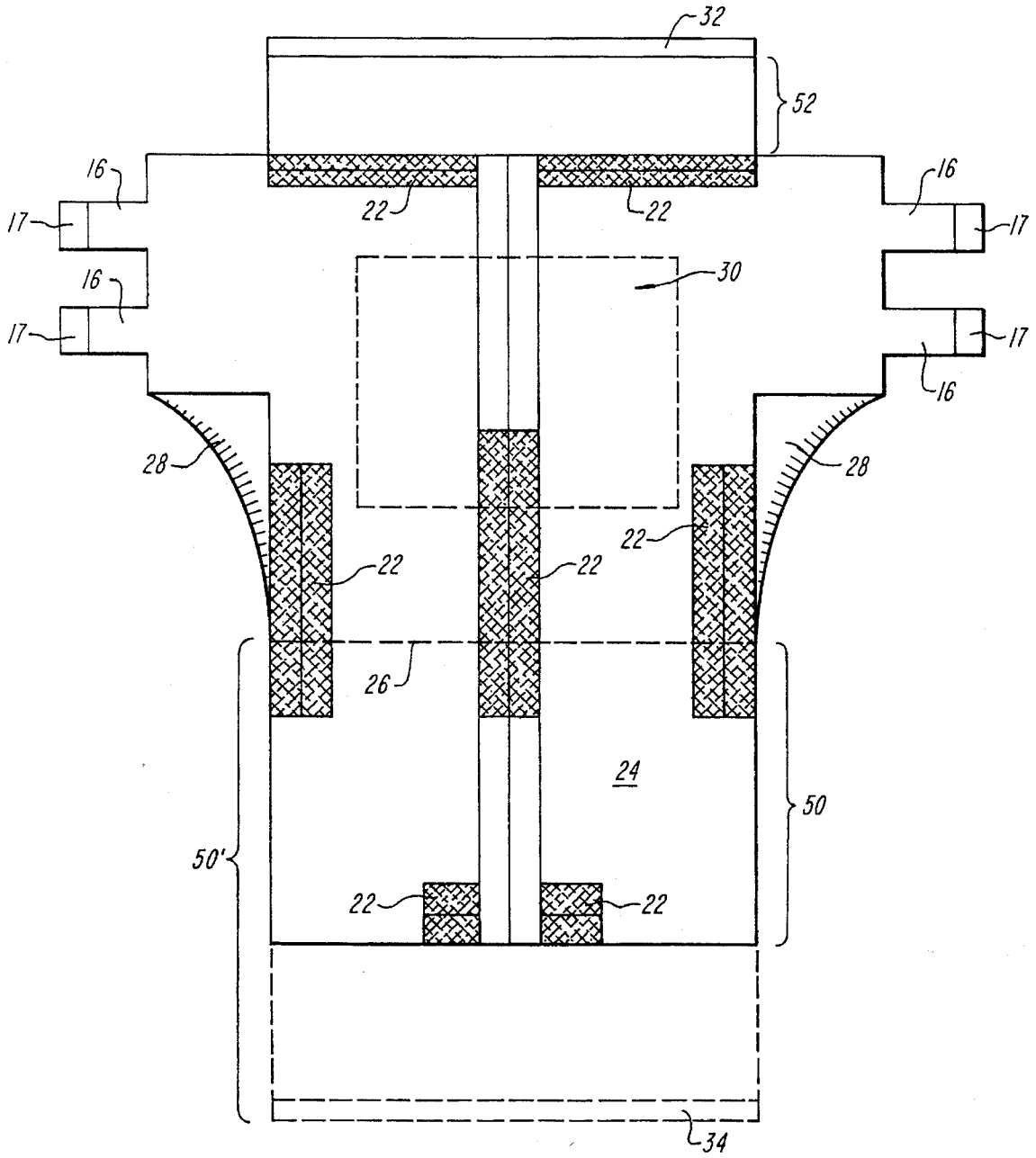
FIG. 2 illustrates a plan view of the inner surface of an embodiment of the present invention.
Figure 3:
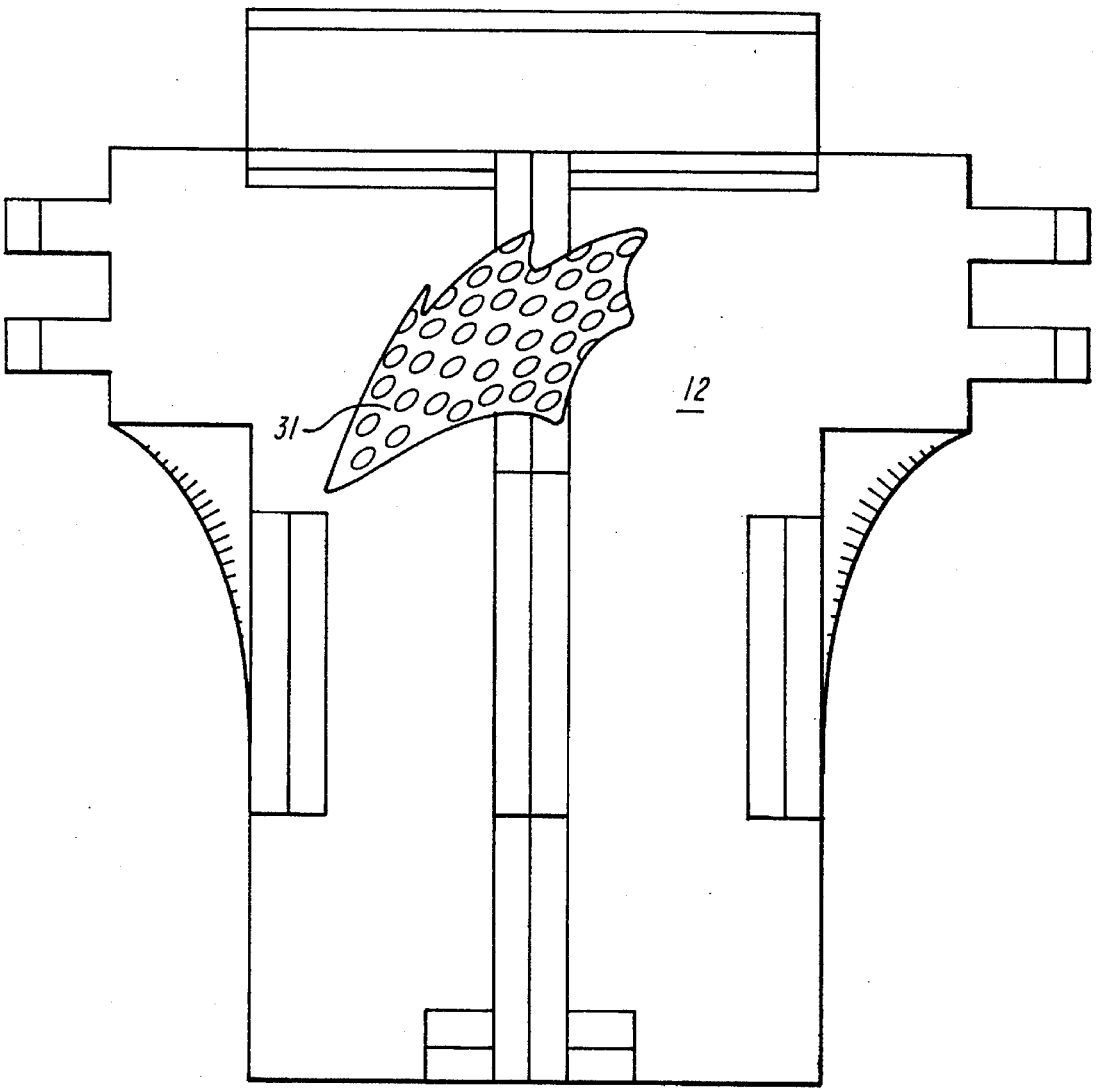
FIG. 3 illustrates a plan view of the inner surface of an embodiment of the present invention cut away to show the padding material.

Referring now to FIGS. 2–3, the interior of the conformable container is illustrated. Elasticized areas 22 are provided at desired locations to permit the container to be stretched to conform to the shape of the item being shipped. The elasticized areas 22 can be made by attaching strips of elastic material to one or more of the inner or outer shells or the intermediate padding layers 31 shown in FIG. 3. The elasticized areas 22 are formed by spreading out the container on a surface. The strips of elastic material are then stretched as desired and attached to the container. Once attached, the elastic strips will contract and cause the container to partially fold. The container can then be stretched again to cover the item to be shipped. The inner shell 24 is manufactured from materials such as those that are used for the exterior shell. Softer material may be used for fragile items. Flexible gussets 28 provide additional material to facilitate the enclosure of non-planar and irregularly shaped items. The outer and inner shells 12, 14 can be attached to each other by gluing, heat-sealing, stitching, stapling or other known means. The two shells may be secured together before insertion of the padding layer therebetween, provided that an opening is left through which to insert the padding.

As illustrated in FIG. 3, disposed between the outer shell 12 and inner shell 24 are one or more layers of shock absorbing, padding material 31, such as "bubble-pack" material having resilient air pockets, manufactured by the Sealed Air Corporation and others, kruff, or other cellulose paper products. Other suitable protective material will be known to those of skill in the trade. The number of layers of padding 31, and the specific type of padding required, depends upon the fragility of the item being shipped. The padding material should be flexible enough to conform snugly to the shape of the item to prevent movement of the item during shipment. If desired, the padding material can be used without separate inner or outer shells. In such an embodiment, the outer surface of the padding material itself forms the inner and outer surfaces of the container.

Referring to FIG. 2, the item to be shipped, shown by dotted lines 30, is first placed in position as indicated. A "hinge" 26 is formed in the container, such as by adding a strip of elastic material to create an elasticized folding action at the hinge. The section of the container identified with the numeral 50 is folded snugly over the item. The side tabs 14*a*, 14*b* are folded across the item 30 and snugly held in position around the item 30 by securing fasteners 16. If strips of adhesive material are used with fasteners 16, the strips are fastened to the exterior shell 12 in the approximate locations indicated by the pads 18 to close the container.

After section 50 of the container has been folded over the item and the side tabs securely fastened snugly around the item, section 52 is folded down over section 50 and secured in place by adhesive strip 32. Alternatively, side tabs 14*b*, 14 may be fastened around item 30 before section 50 is folded over the item. Section 52 is then folded over section 50 and secured in place by adhesive strip 32. Adhesive strip 32 may be replaced with a hook and loop material arrangement such as has previously been discussed with respect to the fasteners 16. Provided that the item is securely packaged for shipping, the order in which the tabs and other sections are folded is not critical.

The elasticized areas 22 and gussets 28 ensure that the container is sufficiently flexible and resilient to be pulled tightly around the item and to conform to the shape of item. Thus, unlike in conventional packaging, there are no significant spaces or voids left around the item which must be filled with additional packing materials. The ability to secure the container snugly around irregularly shaped items is an important feature and benefit of the present invention.

In another embodiment of the invention, section 50 of the container is elongated, as indicated by numeral 50'. In this embodiment, section 50' includes an adhesive strip 34, similar to the previously described adhesive strip 32. Side tabs 14*a*, 14*b* and section 52 of the container are securely fastened around the item. Section 50' is then folded over the item 30 and the adhesive strip 34 is secured in place, for example, in the location identified by the dotted lines 36 in FIG. 1, to complete the packaging of the item. Alternatively, section 52 is first folded over item 30, followed by section 50', and then side tabs 14*a*, 14*b* are fastened in place.

The combination of elements described above provides a secure, well-protected, and easy-to-use container for the shipment of goods. The unitary container dispenses with the need for separate tape, string, boxes or packing materials when packaging an item for shipment. Everything that is needed to package the item is provided in a unitary container. The elasticized areas 22, gussets 28, hinge 26 and padding material enable the shipper to quickly, snugly, and securely package the item. Accordingly, the present invention reduces the time and effort to package items for shipment. The container is simple to unwrap by the recipient, which also saves time and effort. The present invention in one embodiment is preferably intended to be reusable, and such is provided for by the use of Velcro® fasteners or by stacking adhesive strip on the fasteners. The container can also be manufactured to be reversible and reusable. In a reversible form, the fasteners have adhesive strip seals on each surface of the fastener. The strip seals on the first side are peeled away for the first use of the container, and the strip seals on the second side of the fasteners are peeled away for the second use of the container when the container has been reversed. This further reduces the costs associated with the shipment of goods.

Figure 4:
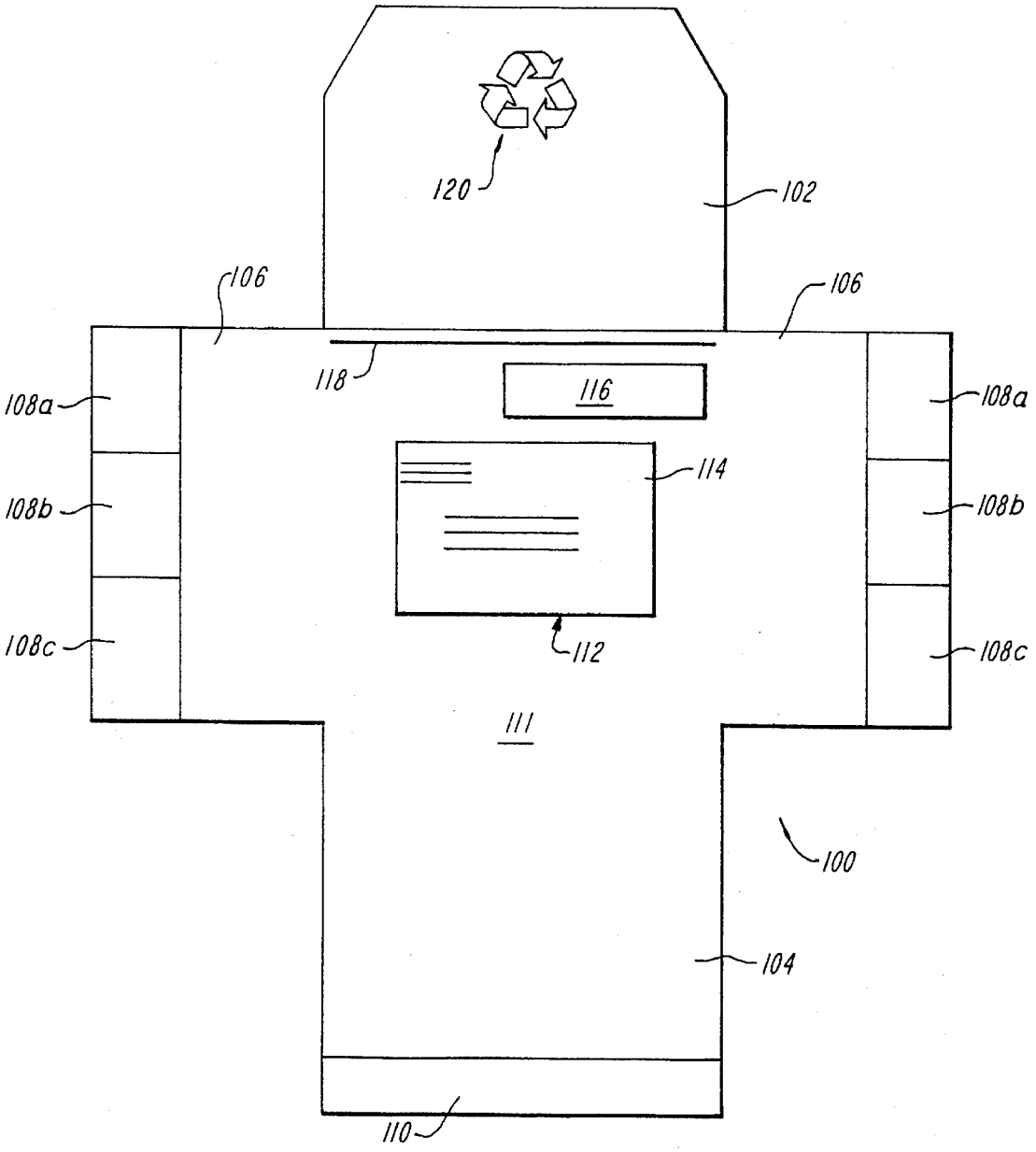
FIG. 4 illustrates a plan view of the exterior of another embodiment of the present invention.
Figure 5:
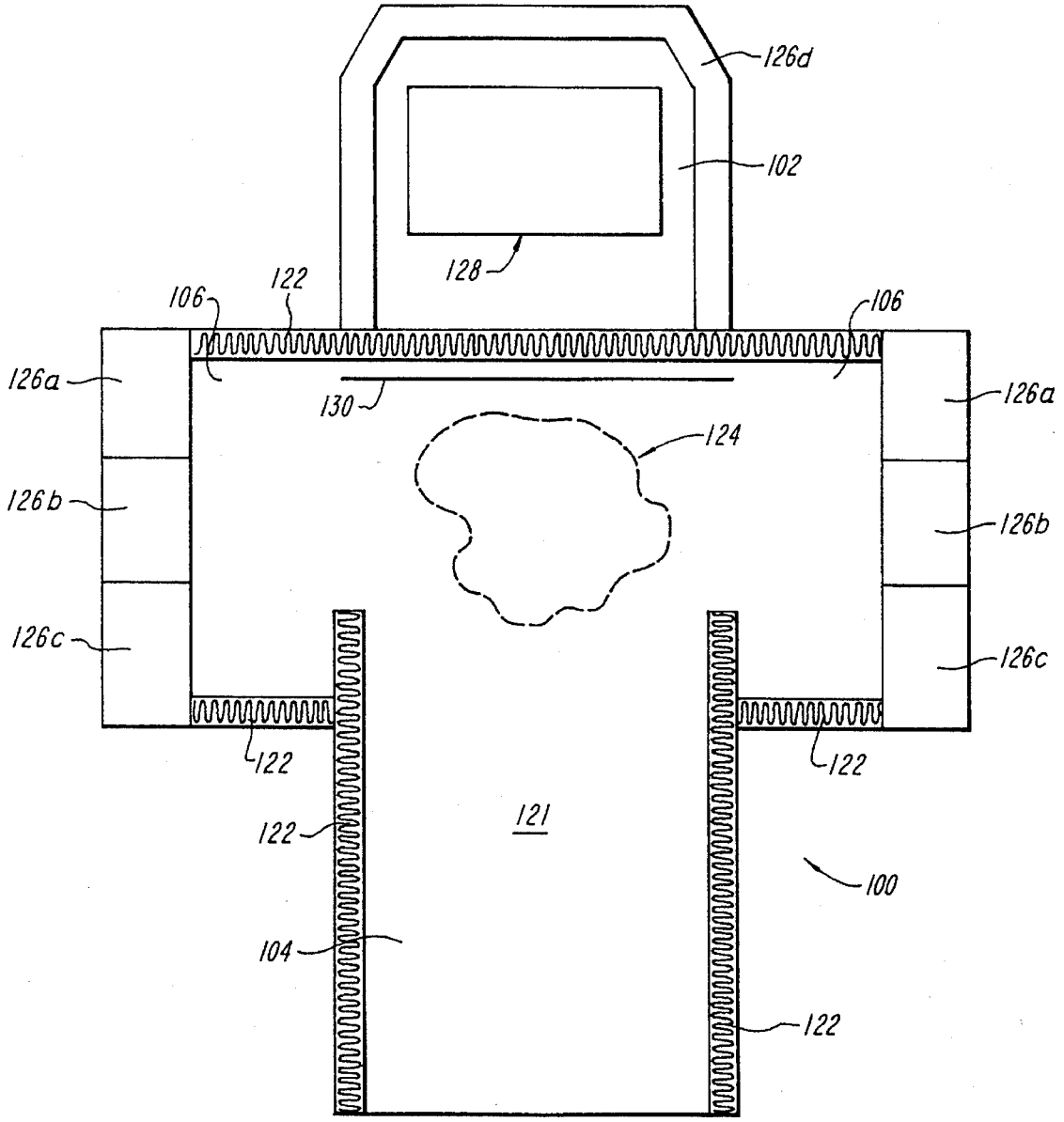
FIG. 5 illustrates a plan view of the interior of another embodiment of the present invention.

Referring now to FIGS. 4 and 5, another embodiment of the present invention is illustrated. In this embodiment, the container body 100 has head and tail sections 102, 104 and side tabs 106 which are integrally formed from the previously described padding material and without separate inner or outer shells. The padding material forms the inner and outer surfaces of the container body 100. Disposed on side tabs 106 are lengths of strip seal 108. The lengths of strip seal 108*a*, 108*b*, 108*c* can be disposed side-by-side, as illustrated, to permit re-use of the container. For example, the first user can use the first pair of strip seals 108*a*, the second user the second pair 108*b*, and the third user the third pair 108*c*. A length of strip seal 110 is also disposed on the tail section 104 of the container body 100. Alternatively, the lengths of strip seal can be stacked to permit re-use of the container. Other sealing methods, such as Velcro® strips or heavy duty adhesive, can be used in place of strip seals. For example, a resilient tongue-and-groove fastener, such as that exemplified by the "Ziploc" trademarked brand of products, can be used. The groove side of the fastener can be disposed as desired on the outer surface of the container and the tongue side disposed on the inner surface of head section 102 of the container. When the container is wrapped around the item, the tongue side is pressed into engagement with the groove side to complete the wrapping process. The recipient begins to unwrap the item by disengaging the two sides. By employing such fasteners, reuse of the container is facilitated.

Also disposed on the exterior 111 of the container body 100 is a transparent pocket 112 in which an address label 114 can be placed bearing the names of the addressee and the sender. Extra blank address labels can also be provided in the pocket 112 for subsequent users of the container. An adhesive stamp area 116 can also be provided on the exterior of the container body 100 to which stamps may be affixed without licking or wetting the stamps. A pull tab opener 118, such as a length of thread or plastic embedded in the padding material in known ways, can be provided to facilitate opening the container. The pull tab opener 118 is pulled by the recipient of the container and tears the container to provide an opening through which the contents of the container 100 can be removed. Pull tab openers may not be desirable if re-use of the container is envisaged. A symbol 120 indicates that the container is recyclable.

Referring now to FIG. 5, the interior side 121 of the container body 100 is illustrated. Elasticized areas 122, such as those previously described, are provided which urge the container 100 to curl in a closing action. When an item, shown with dotted lines 124, is placed on the interior side 121 of the container body 100, the side tabs 106 and head and tail sections 102, 104 are pulled and stretched over and around the object to fully close the container. The conformability of the container provided by the elasticized areas 122 allows the container to be tightly conformed to the shape of the item 124 regardless of the shape of the item. Lengths of strip seal 126*a*, 126*b*, 126*c*, 126*d* are disposed on side tabs 106 and on head section 102. Once side tabs 106 and head and tail sections 102, 104 have been conformed to the enclosed item, the lengths of strip seal allow the side tabs 106 to be affixed one to the other, and head section 102 to be affixed over tail section 104, to seal the container. A transparent pocket 128 can be affixed to head section 102 to display printed information such as invoice or shipping documents. A pull tab opener 130 is provided to facilitate opening the container when the container is re-used.

For the first use of the container illustrated in FIGS. 4 and 5, the strip seals 108*a*, 108*b*, 108*c*, 110 shown in FIG. 4 seal the container conformably around the item which is placed on the interior side 121 (shown in FIG. 5) of the container 100. For the second use of the container, strip seals 126*a–d* shown in FIG. 5 seal the container around the item which is placed on the exterior side 111 (shown in FIG. 4) of the container body 100. It will therefore be apparent that the container is reversible and the exterior side of the container 100 for the first use becomes the interior side for the second use.

Figure 6:
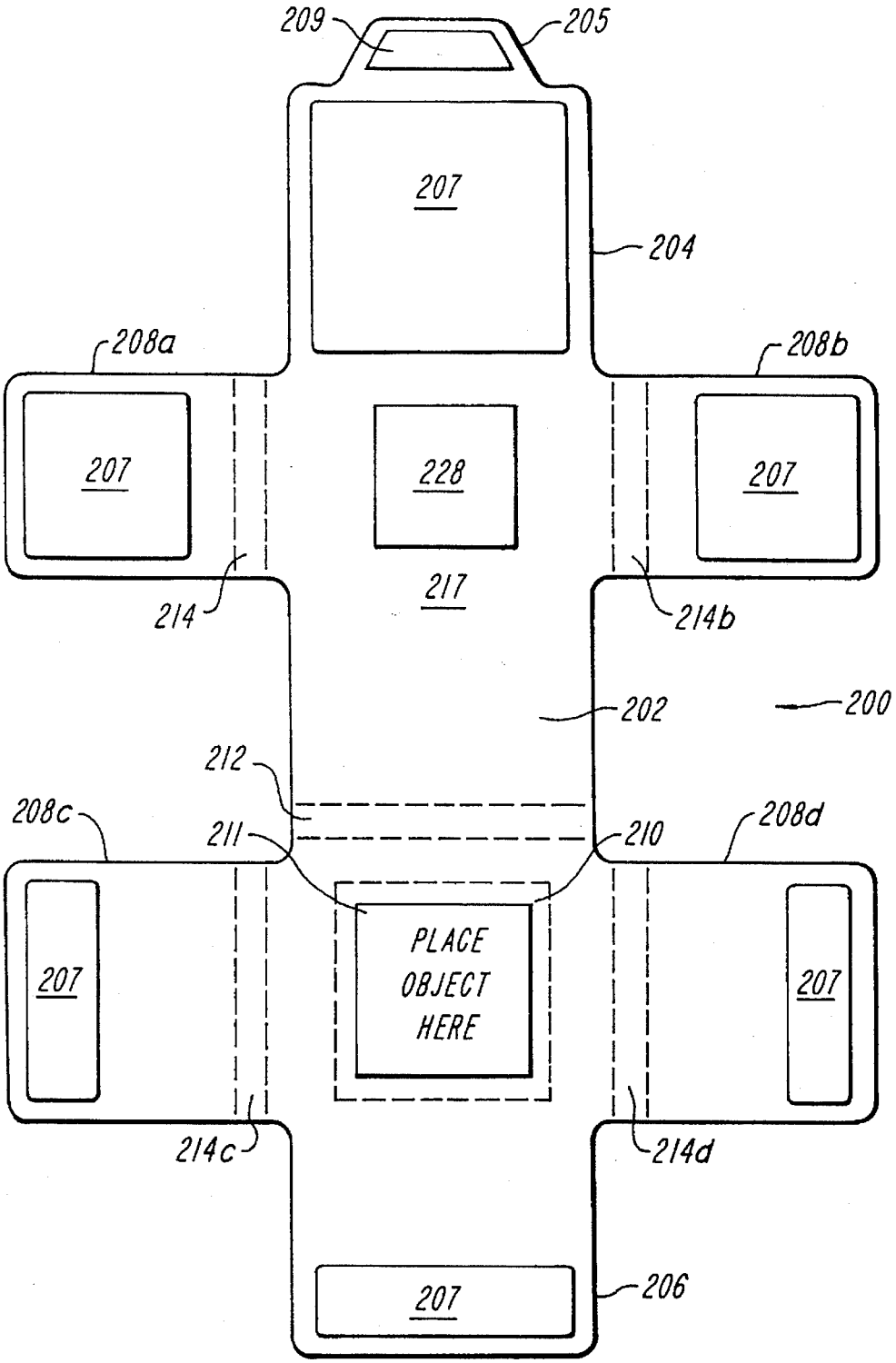
FIG. 6 illustrates a plan view of the inner surface of a yet another embodiment of the present invention.

Referring now to FIG. 6, a double cruciform embodiment of the invention is illustrated. In this embodiment, the container 200 includes an elongated body section 202, a head section 204, a tail section 206, and a plurality of tabs 208*a–d*. To wrap an object in the container, the object is first placed in position, such as that indicated by dotted lines 210 and message 211. Two of the tabs 208*c*, 208*d* and the tail portion 206 are placed around the object first. The remaining tabs 208*a*, 208*b* and head section 204 are then wrapped around the object and fastened in place. The tabs 208*a–d*, head section 204 and tail section 206 can include adhesive strips 207 of material such as Webbplex #1150 and #1175 adhesive tape with release paper, or other known fastening means. The adhesive tape or other type of suitable fastening means can be placed on substantially all, or on less than all, of the surface of the respective tabs and head and tail sections, provided that sufficient fastening strength is achieved to ensure that the container does not inadvertently or accidently become unwrapped during shipment. Likewise, it is not necessary that fasteners be provided on all tabs and end sections. For example, for some applications, it may be sufficient to use fasteners on head section 204 and on tabs 208*a* and 208*b* only, if these areas of the container are the final areas to be wrapped around the object. For greatest flexibility in wrapping, fasteners will be disposed on all tabs and head and tail sections. The fasteners can provide single-use fastening or can be releasable fasteners comprised of a releasable material such as Velcro®, or other suitable materials, to allow reuse of the container. The head section 204 can also include a flap 205 which has a fastener 209. Flap fastener 209 can be made from a more aggressive type of fastener than used for fasteners 207 to deter, and reveal, any tampering with the package when head section 204 is the final portion of the container 200 to be wrapped around the object. In addition, head section 204 can include a line of perforations 242 that provides a weak point in the head section 204 so that the recipient can tear the container across the line of perforations 242 to separate the head section 204 at that location. The object can then be unwrapped and removed.

The container can also include a pocket 228. In a container having multiple layers of material, the pocket can be formed by making a slit in the top layer and sealing the top layer to the adjacent layer as desired to define the periphery of the pocket but leaving the slit open. If the container is made from a single layer of material, the pocket 228 can be formed be affixing a separate piece of material to the inner surface of the container. The pocket 228 can be used to store adverting, instructional, or other information that is intended to be removed and/or read by the recipient.

Figure 7:
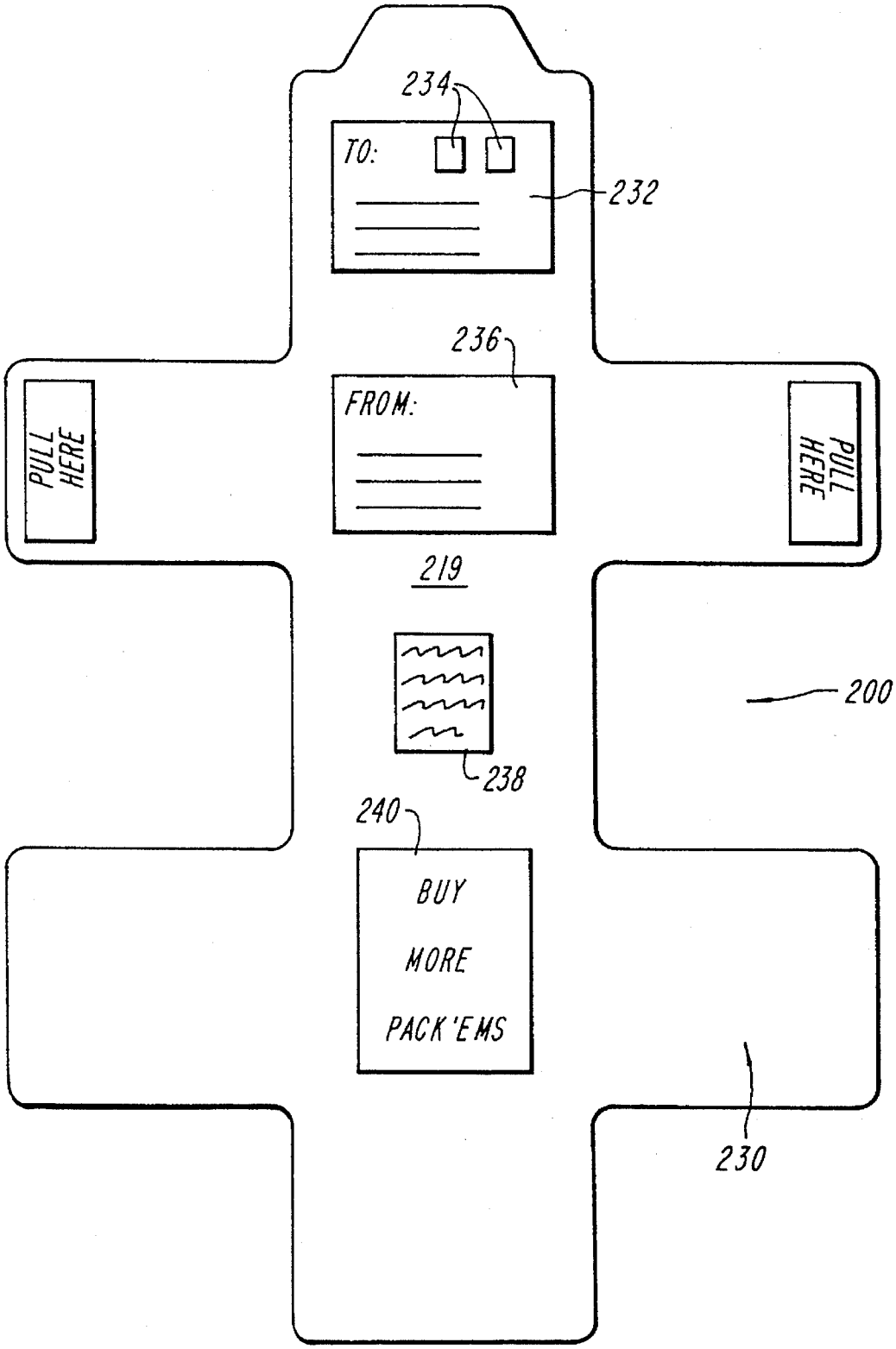
FIG. 7 illustrates a plan view of the outer surface of the embodiment illustrated in FIG. 6.

The container has an inner surface 217, illustrated in FIG. 6, and an outer surface 219, shown in FIG. 7. It will be appreciated that the fasteners can be disposed on either or both surfaces of the container to achieve further flexibility in wrapping the object. If a material such as Velcro® is used, the hook material can be placed on one surface and the loop material on the other surface of the container to ensure mating of the hooks and loops when the object is wrapped.

Referring to FIG. 7, informational panels can be placed on the outer surface 230 of the container 200. Examples of such panels are an address panel 232, having areas 234 to which stamps are affixed, a return address panel 236, and instruction panels 238 that instruct the recipient on how to unwrap the container. Such panels can also be used to display advertising information 240.

The container can be manufactured from a relatively non-stretchable material, for example, plastic "bubble-pack" or cellular air material, without any portion of the container being made of an elasticized material. If a more flexible container is desired, the container body can include portions of elasticized material to permit the container to be stretched around the object being shipped. For example, a strip of elasticized material can be placed at location 212 (shown in outline) to provide greater flexibility in the length of the container 200. For greater flexibility in the width, elasticized strips can be placed, for example, in locations 214*a–d*, which permit the tabs to be stretched around, and conform to, the object. Alternatively, the edges of the container can be elasticized, for example as illustrated in FIGS. 1, 2 and 5, to allow the container to be stretched around the object and to conform to the shape of the object. Depending upon the size of the container, which in turn is dependent upon the size of the objects to be wrapped, the container can also include more than four tabs.

Figure 8:
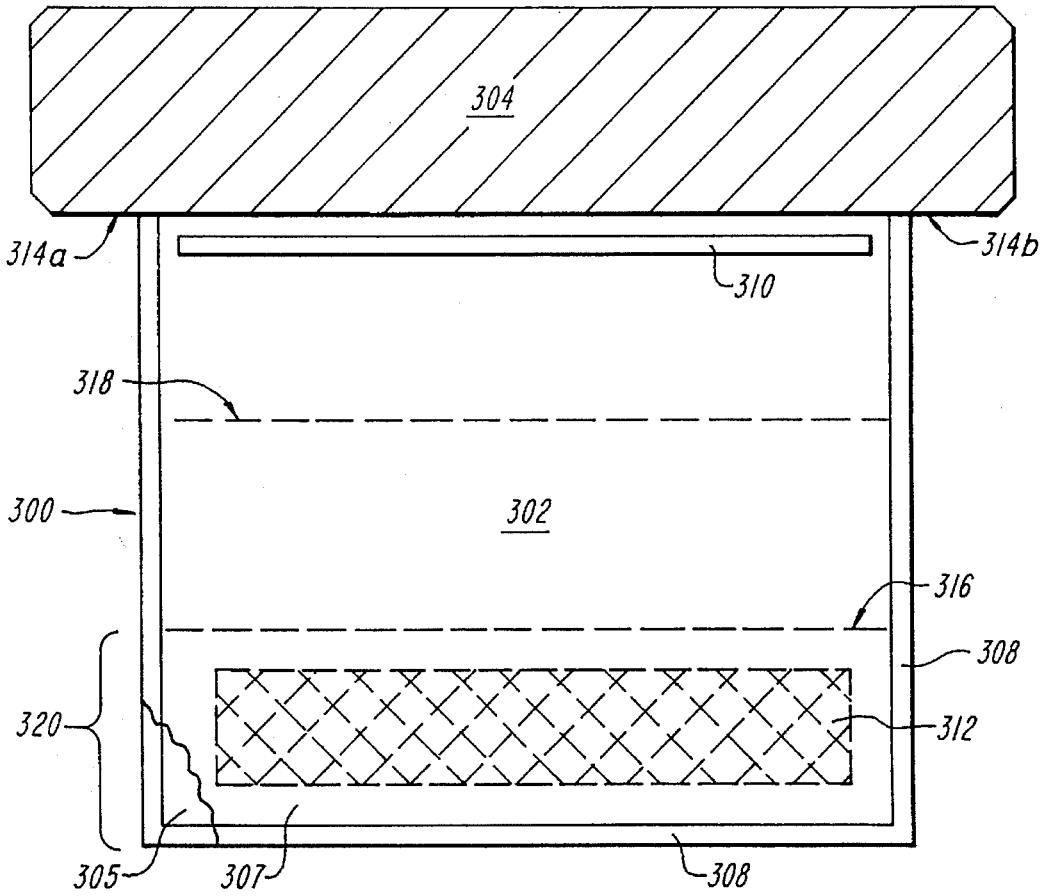
FIG. 8 illustrates a plan view of an unwrapped pocket embodiment of the present invention.
Figure 9:
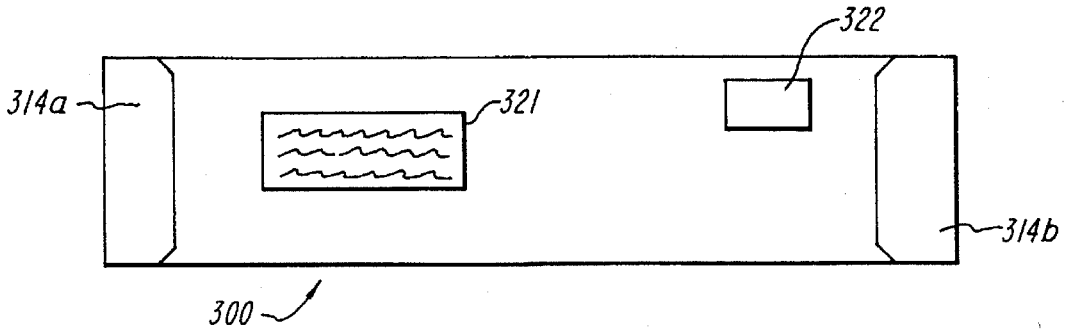
FIG. 9 illustrates a plan view of the wrapped pocket embodiment of the present invention.

Referring now to FIGS. 8 and 9, a pocket embodiment of the present invention is illustrated. In this embodiment, the container 300 includes a body portion 302 and a sealing flap 304. The body portion 302 has an inner pocket that is formed by joining one or more sheets of material together at the periphery 308 of the container 300 to forman inner wall 305 and an outer wall 307. The inner and outer walls 305, 307 can be formed from single or multiple plies of material, depending upon the degree of protection required. The joining can be accomplished by heat sealing, adhesives, stitching, or other known means. A slit 310 can be formed in the inner wall 305 of the container 300. The object being shipped 312 is inserted into the pocket through the slit 310. Alternatively, the inner wall 305 can terminate adjacent the sealing flap 304, as indicated by dotted line 309, to form a pocket. The sealing flap 304 comprises a length of adhesive material with release paper as previously described. The sealing flap 304 includes tab portions 314*a*, 314*b* that extend outwardly from the container 300, as illustrated in FIG. 8. Once the object 312 has been placed in the pocket of the container 300, the container 300 is folded over, for example, along dotted lines 316, 318. In the embodiment illustrated in FIG. 8, the lower portion 320 of the container body portion 302 is folded over twice. Depending upon the size and configuration of the container and the inserted object 312, more or less folds of the body portion 302 may be required to wrap the object. The protection provided to the object increases with the number of folds made to wrap the object 312.

Referring now to FIG. 9, the container 300 shown in FIG. 8 is illustrated in a wrapped and sealed condition. Once the container 300 with the object 312 inside has been folded, the sealing flap 304 is secured to the container 300 with the tab portions 314*a*, 314*b* being folded around the sides of the folded container to further secure the container 300 in a wrapped condition. An address panel 321 and a stamp panel 322, as well as other desired panels as previously described, can be provided on the container.

Figure 10:
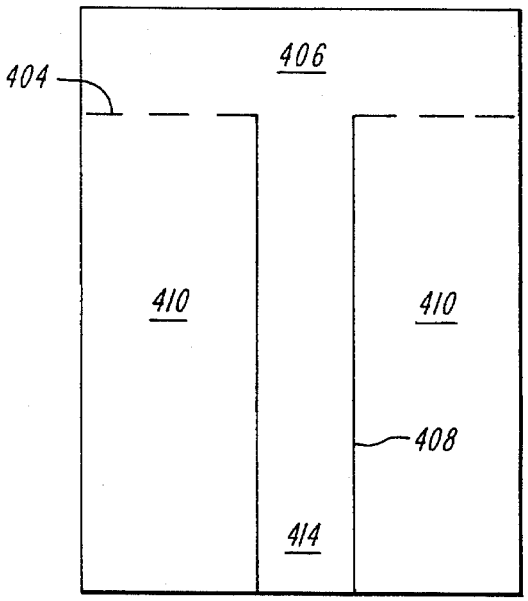
FIG. 10 illustrates a plan view of a further embodiment of the present invention.
Figure 11:
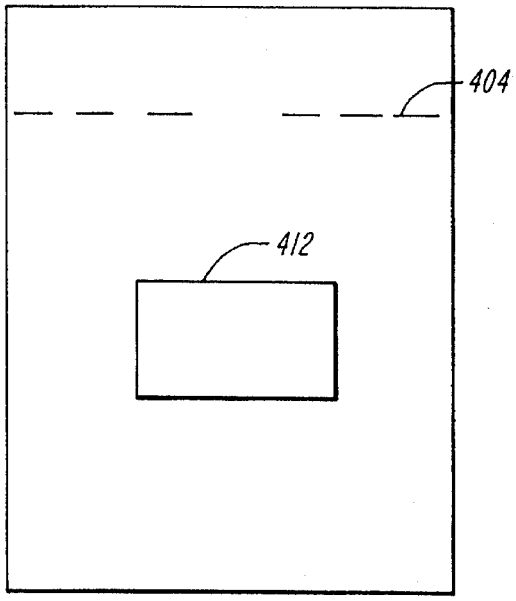
FIG. 11 illustrates a plan view of the outer surface of the embodiment of FIG. 10.

An alternative version is shown in FIGS. 10 and 11 in which there is no pocket. Referring to FIGS. 10 and 11, this embodiment comprises a body portion of generally rectangular configuration having perforations 404 extending from respective side edges inward by a predetermined amount to provide a sealing flap 406. Lines 408 or creases or other visual indicia may be provided as illustrated along the length of the body portion at a position at which the perforations 404 end to demark fold lines along which the sections 410 of the body can be folded in wrapping the package. The opposite surface, illustrated in FIG. 11, may contain an address label 412, as illustrated, which may be part of the package or separately applied thereto. The sealing flap 406 has adhesive thereon and a release sheet as described above.

For use of the embodiment of FIGS. 10 and 11, the perforations 404 are torn to provide side flaps 410 and an object to be wrapped is typically placed at the lower portion of the body in the region indicated by reference numeral 414. The side flaps 410 are folded inward over the object and the body portion is then folded up toward the sealing flap 406 which is then folded over and around the folds, after removal of the release paper to thereby adhesively seal the package.

In a further alternative version of the embodiment of FIGS. 10 and 11, the body portion may be of generally T-shape in its open condition. In this version, there are no side flaps 410, and an object is placed at the bottom of the body portion which is then folded toward the sealing flap. After the release paper is removed, the sealing flap is folded downward and around to seal the package.

Figure 12:
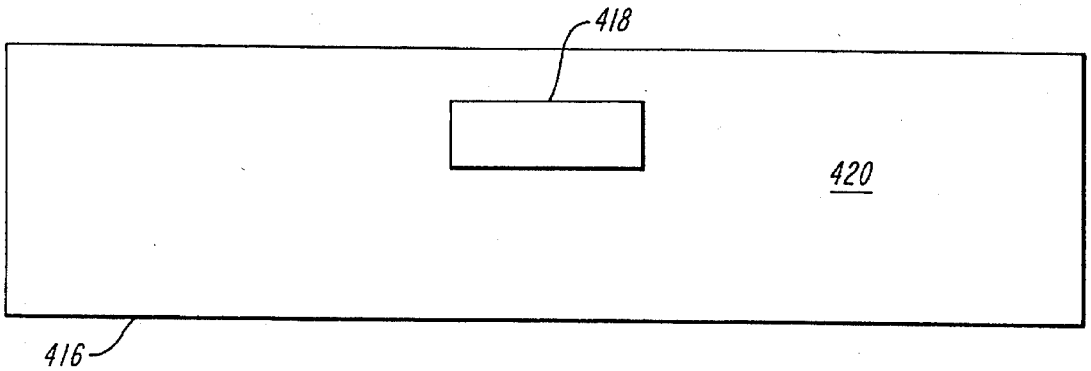
FIG. 12 is a plan view of a sealing tape employed in yet other embodiments of the invention.

In yet other embodiments of the invention, the flaps of the package do not contain adhesive. A sealing tape 416 such as illustrated in FIG. 12 is provided with adhesive on a surface thereof covered by a release sheet, and which will preferably contain an address label 418 on the surface 420 opposite to the adhesive surface as illustrated. This sealing tape may be provided as a separate element or may be removably affixed to the package, for example, as an extension of one of the package flaps. This sealing tape may be employed with packages of any of the configurations described above. As used with an embodiment such a shown in FIG. 10, the perforations 404 are torn and an object is placed at the lower portion 414 of the body, and the side flaps 410 are wrapped over the object and the body thus wrapped is then folded upward toward the flap 406 which here contains no adhesive. The flap 406 is folded over the wrapped portion and the outer side portions of flap 406 are wrapped around the package. The release paper is removed from the sealing tape 416 (FIG. 12) and the tape is applied on the upper surface of the folded flap 406 and then wrapped around the folded flaps of the package to substantially seal the package in its folded state. The shipping label is accessible and visible on an exposed face of the wrapped package.

Figure 13:
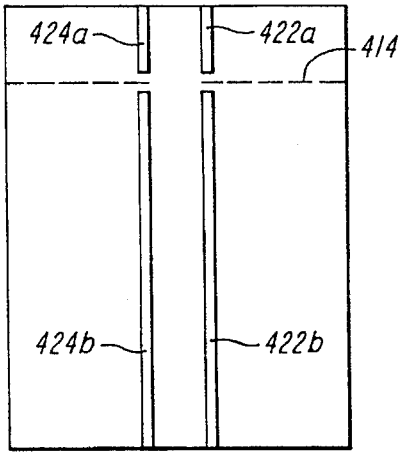
FIG. 13 is plan view of an embodiment of the invention incorporating protective runners.
Figure 14:
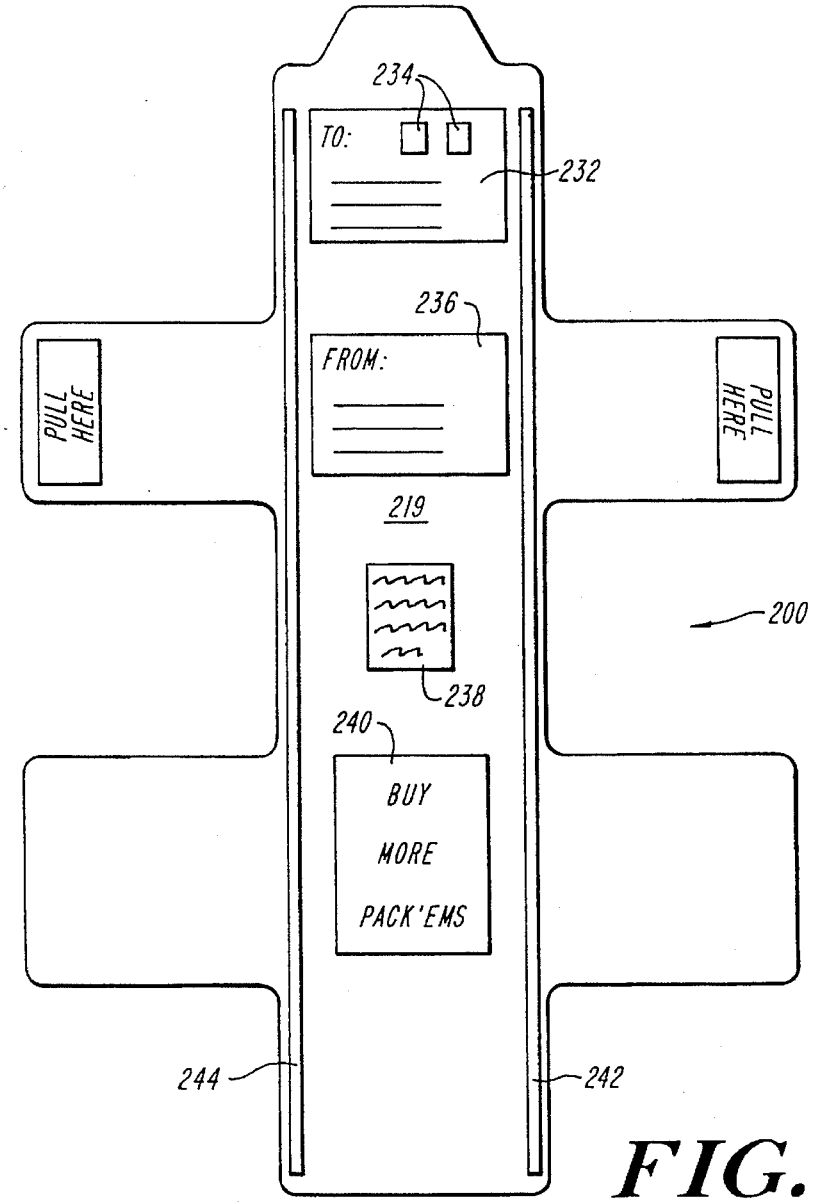
FIG. 14 is plan view of another embodiment of the invention incorporating protective runners

Referring now to FIGS. 13 and 14, two embodiments of the invention incorporating protective runners are illustrated. In FIG. 13, the protective runners 422*a*, 422*b*, 424*a*, 424*b*, extend substantially along the length of the package that is illustrated in FIG. 10. The runners are made of a flexible material and are attached to the package in a known manner. The runners should be sufficiently flexible to conform to the shape of the contents when the package is wrapped and sealed. The runners act as shock-absorbers to provide extra protection to the contents of the package once the package has been sealed. In the embodiment of FIG. 13, the runners are discontinuous at the perforations 404 in order to facilitate folding the flap into position. In FIG. 14, the protective runners 242, 244 extend substantially along the length of the package illustrated in FIG. 7. The location, size, length and number of the runners can be varied according to the area of the package at which further protection is desired.

It will be appreciated that the thickness of the material from which the container is manufactured can be increased in order to provide added protection to heavy or delicate objects, such as when computer equipment and disks, are being shipped or moved between from one location to another. To achieve a greater thickness, for example, "bubble-pack" having larger bubbles can be used. Alternatively, multiple layers of "bubble-pack" or other suitable stretchable or non-stretchable material can be used. In addition, the protective runners disclosed herein can be made from any suitable material such as hollow resilient plastic tubing, sold strips of styrofoam and similar protective materials known to those in the field.

The present invention is not limited to any particular dimensions. Likewise, the invention can be manufactured entirely from a non-elasticized material, such as "bubble-wrap", entirely from an elasticized, or other suitably stretchable, material, such as "Spandex" or "Lycra", or from a combination of elasticized and non-elasticized materials, depending upon the degree of flexibility desired. The elasticized areas can also be made of various materials, and in various dimensions and configurations according to the needs of the shipper and the shape of the items being shipped. It will likewise be known to those skilled in the art that modifications of the invention can be practiced within the spirit of the invention. Accordingly, the scope of the invention is limited only by the scope of the claims.

What is claimed:

1. A double cruciform shipping container for packaging a three-dimensional object of a given shape, comprising:

first and second flexible, padded container sections connected by a body section, said first container section having first and second opposing tabs with first and second adhesive strips, respectively, and a tail section with a third adhesive strip, said second container section having third and fourth opposing tabs with fourth and fifth adhesive strips, respectively, and a head section with a sixth adhesive strip, said second container section further including a pocket formed to receive written materials, wherein the object may be packaged by first placing the object in said first container section, then wrapping said first and second tabs and said tail section around the object and folding said second container section over the object and wrapping said third and fourth tabs and said head section around the object, and securing each of said tabs in place with the adhesive strips associated therewith, said container thereby adopting the shape of the object being packaged such that voids between the object and said container are eliminated.

2. The double cruciform shipping container of claim 1 including first and second elasticized strips disposed between said first and second opposing tabs, respectively, and said first container section.

3. The double cruciform shipping container of claim 2 further including third and fourth elasticized strips between said third and fourth opposing tabs, respectively, and said second container section.

4. The fouble cruciform shipping container of claim 1 wherein said head section includes a flap fastener for revealing tampering with said head section.

* * * * *